United States Patent [19]

Bertram et al.

[11] Patent Number: 4,979,297

[45] Date of Patent: Dec. 25, 1990

[54] ROTARY SHAVING HEAD FOR AN ELECTRIC SHAVING APPARATUS

[75] Inventors: Leo Bertram, Stolberg, Fed. Rep. of Germany; Hugo Schemmann, Schaesberg, Netherlands

[73] Assignee: U.S. Philips Corp., New York, N.Y.

[21] Appl. No.: 283,410

[22] Filed: Dec. 12, 1988

[30] Foreign Application Priority Data

Dec. 23, 1987 [DE] Fed. Rep. of Germany ..... 3743735

[51] Int. Cl.[5] ..... B26B 19/06; B26B 19/14

[52] U.S. Cl. ..... 30/34.1; 30/43.2

[58] Field of Search ..... 30/43.5, 43.6, 346.51, 30/43.2, 34.1, 43.91

[56] References Cited

U.S. PATENT DOCUMENTS 3,125,808 3/1964 Starre ..... 30/43
4,594,778 6/1986 Dona et al. ..... 30/43.6 X
4,649,642 3/1987 Nagasaki et al. ..... 30/34.1

FOREIGN PATENT DOCUMENTS 45-14048 6/1970 Japan .

*Primary Examiner*—Douglas D. Watts
*Attorney, Agent, or Firm*—Ernestine C. Bartlett

[57] ABSTRACT

The invention relates to a rotary shaving head (2) for an electric shaving apparatus, the shaving head comprising a rotary cutter (23) which is driven by an electric motor (3) and which comprises a cutter disc (54) whose periphery is provided with an annular configuration of cutter blades (52) which are offset from the plane of the disc and whose cutting edges (59) co-operate along a cutting plane with a shear plate (24) formed with hair entry apertures (57). The rotary cutting (23) and the shear plate (24) are constructed for rotation of the rotary cutter (23) in both directions of rotation and the rotary cutter (23) is adapted to be driven by a single-phase synchronous motor (3, 3') having a permanent-magnet rotor (9, 65).

6 Claims, 6 Drawing Sheets

ROTARY SHAVING HEAD FOR AN ELECTRIC SHAVING APPARATUS

FIELD OF THE INVENTION

The invention relates to a rotary shaving head for an electric shaving apparatus, the shaving head comprising a rotary cutter which is driven by an electric motor and which comprises a cutter disc whose periphery is provided with a annular configuration of cutter blades which are offset from the plane of the disc and whose cutting edges co-operate along a cutter plane with a shear plate formed with hair entry aperture.

BACKGROUND OF THE INVENTION

Rotary shaving heads of this type are known from DE-AS 11 21 506, which corresponds substantially to U.S. Pat. No. 3,125,808, and their performance is competitive with that of vibration shaving heads. The advantage of rotary shaving heads as compared with vibration shaving heads is that they are better capable of catching and shaving long hairs. The cutter blades have contact faces which move along the cutting plane of the shear plate, cutting edges being sitauted at the front viewed in the given cutting direction. Thus, the shaving head is intended for one specific direction of rotation of the rotary cutter. When the drive motor is a single-phase synchronous motor, this motor, must be provided with an anti-reversal device which inhibits or blocks rotation in the opposite direction, i.e. a direction opposed to the orientation of the cutting edges of the cutter blades. The use of an anti-reversal device enables unidirectional operation to be obtained but has the disadvantage that the anti-reversal device is an additional part and produces annoying noise.

SUMMARY OF THE INVENTION

An object of the invention is to provide an economical and compact rotary shaving apparatus.

According to the invention this object is achieved in that the rotary cutter and the shear plate are constructed for rotation of the rotary cutter in both directions of rotation and in that the rotary cutter is adapted to be driven by means of a single-phase synchronous motor having a permanent magnet rotor.

If the rotary cutter is constructed for rotation in both directiones of rotation and is consequently capable of performing its cutting action in both directions of rotation, no anti-reversal device is needed when the drive motor is a single-phase synchronous motor. This makes the construction of the apparatus more economical because the parts of the anti-reversal device are dispensed with. The problem of the annoying noise produced by an anti-reversal device is then also solved. The single-phase synchronous motor combines a high output power with a compact construction, so either that a small shaving apparatus can be realized or more space is available for the designer.

In a further embodiment of the invention (a) the angle of inclination $\alpha$ of the central axis of each cutter blade with the plane of the cutter disc and the plate of the shear plate, which extends parallel thereto, is 90°, (b) in the circumferential direction each cutter blade is symmetrically relative to said central axis, (c) the central axes of the hair-entry apertures in the shear plate extend in radial directions and the hair entry apertures are disposed symmetrically relative to said central axes, (d) each cutter blade has a contact face which is movable along the cutting plane of the shear plate and which is bounded by two oppositely directed cutting edges which extend substantially radially summetrically relative to the radial central axes of the contact faces.

The symmetrical shape of the cutter blades in a vertical direction relative to the cutting plane of the shear plate simply yields cutters which can rotate in both directions of rotation and which provide a cutting action in both directions of rotation.

In a further embodiment of the invention the thickness of the webs between the hair-entry apertures in a direction perpendicular to the cutting plane is greater than approximately 0.1 mm, and is preferably between 0.1 mm and 0.5 mm. The rotary shaving head than has a cutting performance worse than that of a similar head with thinner webs between the hair entry apertures. However, this rotary shaving head is not intended as a single shaving head serving to provide a complete shave; it is rather intended for use in a combined shaving apparatus which is also equipped with a vibration shaving head. Hairs in the neck or in other problematic areas which are not caught by a vibration shaving head are prebent reliably and without irritation by the rotary shaving head with thicker lamellae. Final shaving is then effected by means of the vibration shaving head.

BRIEF DESCRIPTION OF THE DRAWINGS

The invention will now be described in more detail, by way of example, with reference to the accompanying drawings. In the drawings.

DETAILED DESCRIPTION OF PREFERRED EMBODIMENTS

Figure 1A:
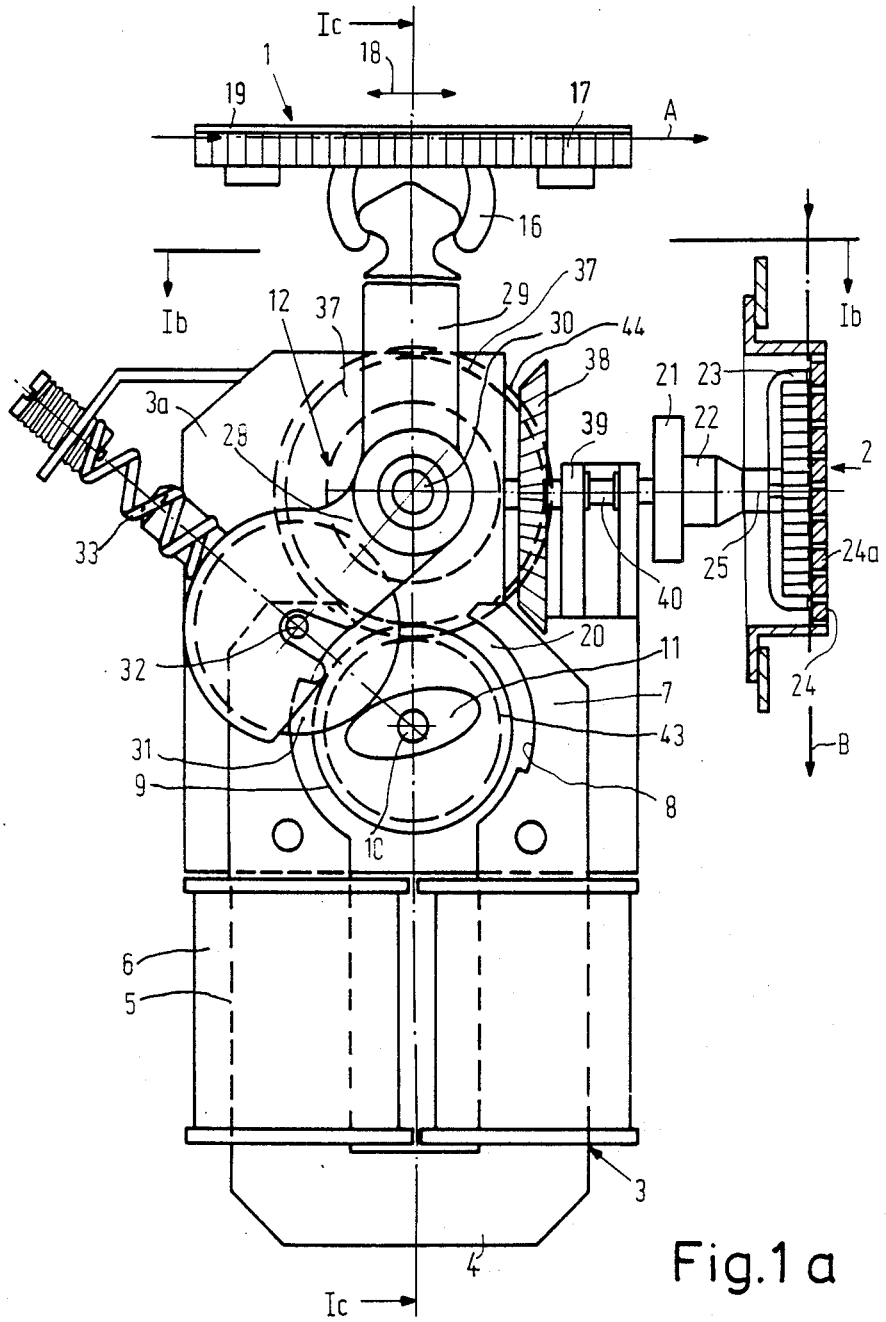
FIG. 1*a* shows a shaving apparatus comprising a rotary and a vibration cutter assembly, which operate in different working planes and which are driven by a single-phase synchronous motor, the rotary cutter assembly being provided for driving in two directions.

FIGS. 1*a* to 1*e* show a shaving apparatus comprising two shaving head assemblies operating in two different working planes A and B, i.e. a vibration shaving-head assembly 1 and a rotary shaving head assembly 2. A two-pole single-phase synchronous motor 3 is secured to a base plate 3*a* situated in the housing, not shown, of the shaving apparatus. The single-phase synchronous motor 3 comprises a U-shaped stator iron 4 and exciter coils 6 arranged on the stator limbs 5. between the stator poles 8 at the free ends 7 of the stator iron a permanent magnet rotor 9 is mounted so as to be rotatable about an axis of rotation 10 which extends perpendicularly to a broad side 3*b* of the apparatus. The rotor 9 is capable of rotating in both directions of rotation.

The rotor shaft 10 carries a double can 11, which via a swing lever converter 12 and coupling means 16 is capable of reciprocating a vibration cutter 17 in the direction indicated by a double arrow 18. The cutter 17 co-operated with a shear foil 19 which is vaulted over the cutter 17. Moreover, the rotor 9 drives a coupling member 21 by means of a bevel gear drive 20. A coupling sleeve 22 is axially movable in the coupling member 21 and is locked against rotation relative to the coupling member. The coupling sleeve 22 carries a rotary cutter 23, which can rotate in a lamellar shear plate 24. The lamellal 24*a* extend in a radial direction relative to the axis of rotation 25 of the rotary cutter assembly 2.

The swing-lever converter 12 comprises a bell-crank lever comprising a first lever arm 28 and a second lever arm 29. The bell-crank lever 28/29 can oscillate about a fulcrum 30.

The first lever arm 28 carries a pressure roller 31, which can roll in a thrust bearing 32. A pressure spring 33, the first lever arm 2, with its pressure roller 31 against the double cam 11. Further details of this swing lever converter 12 are described in DE-PS 34 04 297.

By means of the swing lever converter 12 the vibration cutter assembly 1 is caused to reciprocate via the second lever arm 29 and the coupling member 16.

Whereas the vibration cutter assembly 1 operates in a working plane A the rotary cutter assembly 2 is operated in a separate working plane B. The mechanism 20 used for this purpose comprises a toothed wheel 43 which is flanged onto the rotor shaft 10 and which is clearly visible in particular in FIG. 1*c*. This toothed wheel 43 is in mesh with a further toothed wheel 44. This futher toothed wheel 44 is fixedly connected to a bevel gear wheel 37 (FIGS. 1*b* and 1*c*). Finally, the bevel gear wheel 37 is in mesh with a further bevel gear wheel 38, which is supported in bearings 39. The shaft 40 of the second bevel gear wheel 38 drives the coupling member 21 and via this member the coupling sleeve 22 which engages with the rotary cutter 23 which rotates inside the cap-shaped lamellar shear plate 24.

Figure 1B:
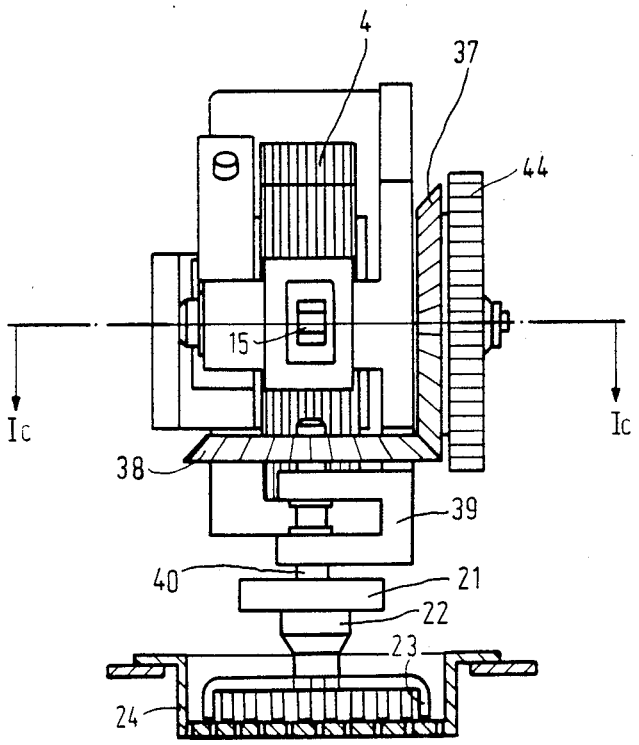
FIG. 1*b* is a plan view of the drive system along the line Ib—Ib in FIG. 1, with the vibration cutter assembly removed.
Figure 1C:
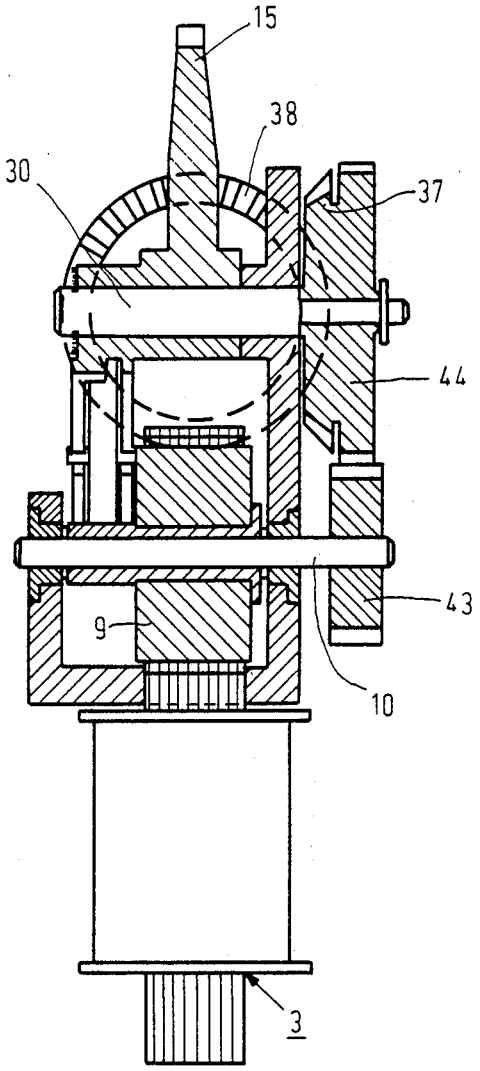
FIG. 1*c* is a sectional view of the drive system of FIG. 1*a*, taken on the line Ic—Ic in FIG. 1*b*.

The bevel-gear construction which is difficult to recognize in FIG. 1*a*, becomes apparent from FIGS. 1*b* and 1*c*, and the view Ib and the sectional view Ic in FIG. 1*a*. The drive system 20 enables the revolution number of the rotary cutter to be adapted and the rotary cutter assembly 2 to be arranged closer to the vibration cutter assembly 1.

Figure 1D:
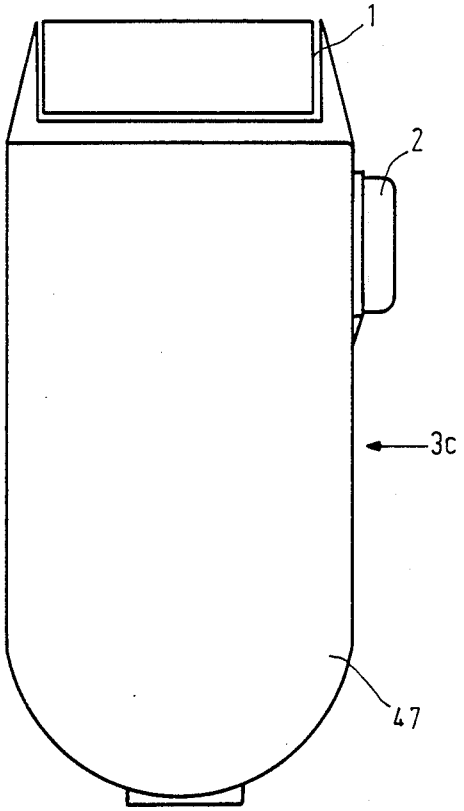
FIG. 1*d* shows the exterior of the apparatus, viewed at a broad side.
Figure 1E:
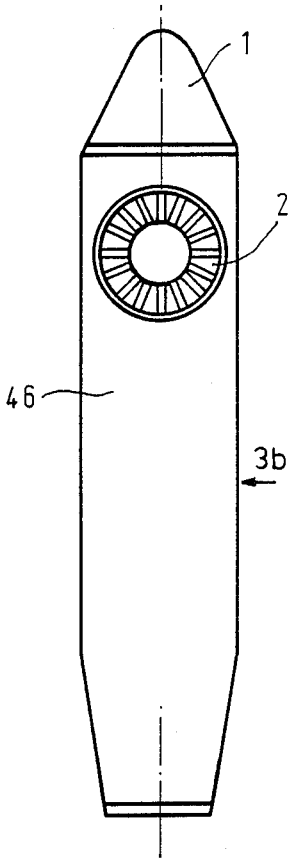
FIG. 1*e* shows the exterior of the apparatus, viewed at a narrow side.

FIGS. 1*d* and 1*e* show how in the case of such a drive arrangement the rotary cutter assembly 2 is mounted in a narrow side 3*c* of the apparatus. This provides a good maneuverability during use of the rotary cutter assembly 2.

Figure 2A:
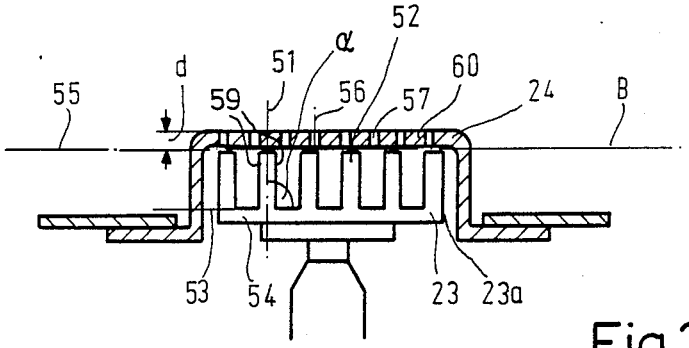
FIGS. 2*a* and 2*b* show the radial rotary center assembly.
Figure 2B:
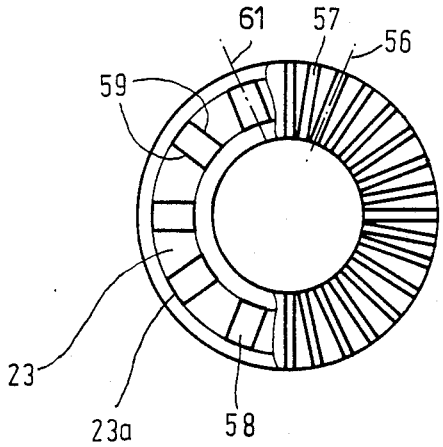

FIGS. 2*a* and 2*b* show the rotary cutter assembly comprising the rotary cutter 23 and the shear plate 24 to an enlarged scale. The rotary cutter 23 comprises a cutter disc 54 along whose periphery 23*a* cutter blades 52 are offset from the plane of said disc. The blades 52 are arranged in an annular configuration along the periphery 23*a*. It can be seen that the angle of inclination $\alpha$ of the central axis 51 of each blade 52 relative to the plane 53 of the cutter disc 54 and the cutting plane 55 of the shear plate 24 which extends parallel thereto, is 90°, the blades 52 being symmetrical relative to the central axis 51 in the circumferential direction. It is then not necessary for the side walls 59 to extend parallel to the central axes 56. The central axes of the individual hair entry apertures 57 in the shear plate 24 extend in radial directions. The hair-entry apertures 57 are symmetrical relative to the central axes 56 in the circumferential direction. Each blade 52 has a contact face 45 which is movable along the cutting plane 55 of the shear plate 24 and which is bounded by two oppositely oriented cutting edges 5. The cutting edges 59 extend symmetrically relative to the radial centeral axes 61 of the contact faces 58. This enables the rotary cutter 23 to be rotated in an arbitrary direction.

The webs 60 between the hair entry apertures 57 have a thickness d greater 0.1 mm in a direction perpendicular to the cutting plane 55. Preferably, the thickness d is between 0.1 mm and 0.5 mm.

The preferred revolution number of the rotary cutter 23 is 2000 r.p.m.

Figure 3:
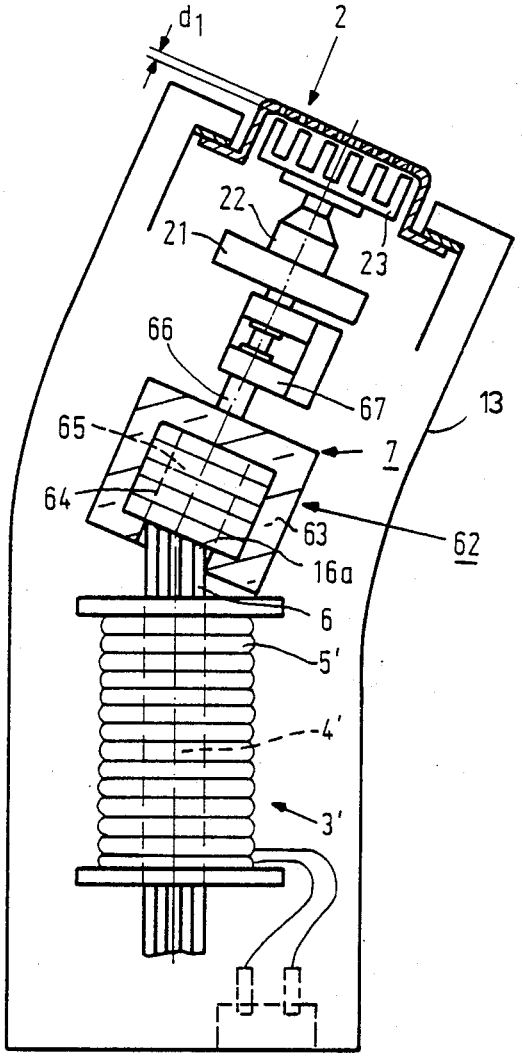
FIG. 3 shows a simple embodiment of the rotary shaving apparatus comprising a bidirectional single-phase synchronous motor and a rotary cutter.

FIG. 3 shows how a single-phsse synchronous motor 3' of modified construction is arranged inside a housing 13. Exciter coils 5' are arranged on the U-shaped stator iron 4'. A drive member 62 is mounted on the free ends of the stator iron 4' and comprises a plastics housing 62 in which the pole iron portions 64 are situated between whose pole pieces the rotor 65 of the two-pole single-phase shynchronous motor 3' is arranged. The shaft 66 of the rotor 65 is supported in the plastics housing 63 by means of bearings, not shown. A further hearing 67 is situated outside the motor. For further details a this motor construction reference is made to DE-OS 34 23 777 which corresponds substantially to U.S. Pat. No. 4,684,840 issued Apr. 14, 1980.

In order to drive the rotary cutter assembly 2 the shaft 66 acts on the coupling member 21 in which the coupling sleeve 22 is mounted for axial movement but is locked against rotation. The coupling sleeve 22 engages with the rotary cutter 23 which rotates in the shear plate 24 shown in FIGS. 2*a* and 2*b*.

A shaving apparatus as shown in FIG. 3 can be very compact and is consequently easy to handle. The lamella thickness $d_1$ is between 0.05 mm and 0.1 mm to obtain a better cutting action.

What is claimed:

1. A rotary shaving head for an electric shaving apparatus, the shaving head being present as a component of a combined apparatus which also comprises a vibratory foil shaving head, said rotary shaving head comprising a rotary cutter (23) which is driven by an electric motor (3) and a cutter disc (54) the periphery of which is provided with an annular configuration of cutter blades (52) which are offset from the plane (53) of the disc and whose cutting edges (59) co-operate along a cutting plane (55) with a shear plate (24) formed with hair entry apertures (57), wherein the cutter blades (52) are symmetrically shaped in a vertical direction relative to the cutting plane (55) of the shear plate (24), the rotary cutter (23) and the shear plate (24) being constructed for rotation of the rotary cutter (23) in both directions of rotation and wherein the rotary cutter is driven by a bidirectional single-phase synchronous motor (3,3') having a permanent-magnet rotor (9,65).

2. A rotary shaving head for an electric shaving apparatus, the shaving head comprising a rotary cutter (23) which is driven by an electric motor (3) and a cutter disc (54) the periphery of which is provided with an annular configuration of cutter blades (52) which are offset from the plane (53) of the disc and whose cutting edges (59) co-operate along a cutting plane (55) with a shear plate (24) formed with hair entry apertures (57), wherein the cutter blades (52) are symmetrically shaped in a vertical direction relative to the cutting plane (55) of the shear plate (24), the rotary cutter (23) and the shear plate (24) being constructed for rotation of the rotary cutter (23) in both directions of rotation and the rotary cutter being driven by a bidirectional single-phase synchronous motor (3,3') having a permanent-magnet rotor (9, 65) and wherein:

(a) the angle of inclination $\alpha$ of the central axis (51) of each cutter blade (52) with the plane (53) of the cutter disc (54) and the plane (55) of the shear plate (24), which extends parallel thereto, is 90°, (b) in the circumferential direction each cutter blade (52) is symmetrical relative to said central axis (51), (c) the central axis (56) of the hair entry apertures in the shear plate (24) extend in radial directions and the hair-entry apertures (57) are disposed symmetrically relative to said central axes, and (d) each cutter blade (52) has a contact face (58) which is movable along the cutting plane (55) of the shear plate (24) and which is bounded by two oppositely directed cutting edges (59) which extend symmetrically relative to the radial central axes (61) of the contact faces (58).

3. A rotary shaving head for an electric shaving apparatus, the shaving head comprising a rotary cutter (23) which is driven by an electric motor (3) and a cutter disc (54) the periphery of which is provided with an annular configuration of cutter blades (52) which are offset from the plane (53) of the disc and whose cutting edges (59) co-operate along a cutting plane (55) with a shear plate (24) formed with hair entry apertures (57), wherein the cutter blades (52) are symmetrically shaped in a vertical direction relative to the cutting plane (55) of the shear plate (24), the rotary cutter (23) and the shear plate (24) being constructed for rotation of the rotary cuttrer (23) in both directions of rotation and wherein the rotary cutter is driven by a bidirectional single-phase synchronous motor (3,3') having a permanent-magnet rotor (9, 65) and wherein the head comprises webs (70) between the hair-entry apertures (57) and the thickness ($d_1$) of the webs is between 0.05 mm and 0.1 mm.

4. A rotary shaving head for an electric shaving apparatus as claimed in claim 2 wherein the head comprises webs (70) between the hair-entry apertures (57) and the thickness ($d_1$) of the web is between 0.05 mm and 0.1 mm.

5. A rotary shaving head as claimed in claim 1 or 2, wherein the rotary shaving head is present as a component of a combined apparatus comprising a vibration shaving head and comprises webs (60) between the hair-entry aperture (57); and the thickness (d) of the said webs (60) in a direction perpendicular to the cutting plane (55) is greater than 0.1 mm.

6. A rotary shaving head as claimed in claim 2 wherein the rotary shaving head is present as a component of a combined apparatus which also comprises a vibratory foil shaving head.

* * * * *